US006638138B1

(12) United States Patent
Luddeneit et al.

(10) Patent No.: US 6,638,138 B1
(45) Date of Patent: Oct. 28, 2003

(54) ARRANGEMENT OF GRINDING MODULES WITH GRINDING TOOLS IN TRACK GRINDERS

(76) Inventors: Michael Luddeneit, Kahlaer Str. 14, Hummelshain (DE), D-07768; Wilfried Scherf, Kahlaer Str. 14, Hummelshain (DE), D-07768

( * ) Notice: Subject to any disclaimer, the term of this patent is extended or adjusted under 35 U.S.C. 154(b) by 0 days.

(21) Appl. No.: 09/937,552

(22) PCT Filed: Mar. 24, 2000

(86) PCT No.: PCT/EP00/02613

§ 371 (c)(1),
(2), (4) Date: Sep. 25, 2001

(87) PCT Pub. No.: WO00/58559

PCT Pub. Date: Oct. 5, 2000

(30) Foreign Application Priority Data

Mar. 25, 1999 (DE) ..... 199 14 274

(51) Int. Cl.[7] ..... B24B 23/00

(52) U.S. Cl. ..... 451/5; 451/1; 451/24; 451/26; 457/58

(58) Field of Search ..... 451/1, 5, 8, 24, 451/26, 347; 457/58, 65, 236, 347, 466, 429

(56) References Cited

U.S. PATENT DOCUMENTS 4,584,798 A * 4/1986 Rivoire ..... 451/347
4,878,318 A * 11/1989 Panetti ..... 451/347
4,920,701 A 5/1990 Panetti
4,993,193 A * 2/1991 Panetti ..... 451/347
5,086,591 A 2/1992 Panetti
5,134,808 A * 8/1992 Panetti ..... 451/28
5,359,815 A * 11/1994 Schrunk et al. ..... 451/347
5,735,734 A * 4/1998 Hertelendi ..... 451/347

FOREIGN PATENT DOCUMENTS

DE 2037461 2/1971
EP 0304960 3/1989

* cited by examiner

*Primary Examiner*—Joseph J. Hail, III
*Assistant Examiner*—Anthony Ojini
(74) *Attorney, Agent, or Firm*—Jordan and Hamburg, LLP

(57) ABSTRACT

An arrangement of grinding modules in a track grinder wherein a radial mismatch in narrow track bend radii can be considered in an exact manner without occurrence of constraining forces, enabling reprofiling to be reproduced in a simple manner. The arrangement provides a grinding tool with five degrees of freedom. Each grinding module is accommodated in an at least approximately vertical manner with a frame and in an at least horizontally manner on the frame with a holder. A housing in the holder is pivotably arranged around a shaft that is at least approximately parallel to the track to be ground. The grinding tool in the housing can be adjusted in a rectangular manner in relation to the track to be ground.

10 Claims, 7 Drawing Sheets

ARRANGEMENT OF GRINDING MODULES WITH GRINDING TOOLS IN TRACK GRINDERS

BACKGROUND OF THE INVENTION

The invention relates to an arrangement of grinding modules with grinding tools in track grinders. Such arrangements are used in reprofiling the head of a track profile, in removal of short waves (groovings) as well as in truing long waves in a driving direction. Mostly grinding wheels are used as grinding tools.

Track grinding machines are already known in which a surface pressure of a grinding module is increased or reduced, depending on whether the grinding module moves over a wave trough or over the top of a wave, so that any such waves are leveled, refer to DE-OS 2 037 461. Furthermore, track grinding machines with hydrostatic control are known which, irrespective of the rising of the line or the train resistance, keep to the rate of advance with high precision. A precise positioning of the grinding wheels is essential for the regeneration of the rails, refer to the grinding machine LRR 8-M of the Speno Company. This, however, is particularly problematic with small radii of curvature (<30 m) since there is a comparatively large radial departure of the grinding modules due to common wheel center distances, in particular when both rails are simultaneously ground.

SUMMARY OF THE INVENTION

It is an object of the present invention to provide an arrangement of grinding modules in a track grinding machine which permits to exactly involve a radial departure in narrow rail curvature radii (<15 m) without provoking reactive forces, and which allows reprofiling in a reproducible and simple way.

The object is realized by the the present invention providing an arrangement of grinding modules with grinding tools in track grinders, characterized in that each grinding tool has five degrees of freedom of movement, whereby two linear movements are transverse to the rail to be ground, two linear movements are at least approximately vertically to the rail to be ground and one rotational movement is about an axis which is directed in parallel to the rail at the respective grinding site. Thereby it is of no concern whether or not the arrangement has to grind only one rail or to simultaneously grind both rails of a track. In the latter case the arrangement can be used with particular effectiveness. Furthermore, the number of grinding modules, which are comprised to a reprofiling unit in a frame, is insignificant, whereby the frame can be made, for example, of tubular steel.

An advantageous arrangement according to the present invention is obtained when at least one grinding module is at least approximately vertically adjustably seated in a frame and at least approximately horizontally and adjustably seated on a mount via the frame. In the mount, there is provided a housing pivotally arranged about an axis, the axis is at least approximately parallel to a rail to be ground, and in the housing a grinding cylinder is at least approximately displaceable at right angles to the rail to be ground. Preferably a measuring wheel is provided for each grinding module and means for carrying out a relative movement between the grinding module and the measuring wheel. In this way it is possible to include a radial deviation for each grinding module, particularly in narrow curves.

In order to have the measuring wheels always engage via their wheel flanges the rail to which they are associated, each measuring wheel is rotationally seated in a seating mount, which is adjustable, transversely to the rail to be worked on, along a guiding means on the frame, by aid of a servo-drive or a drive means and gearing, preferably a lever system. Preferably, horizontal transversal movement of the mount seated on the frame is carried out by way of a fluid transmission gear in dependence on the transversal movement of the measuring wheel. Thus it is possible to drive into three defined positions (driving the reprofiling unit into operation position, into positioning of the grinding modules, and in pressing the grinding modules to the rail) without the necessity of employing expensive sensing means for each position.

Advantageously, the fluid transmission gear comprises a double cylinder with two opposing pistons in a cylinder chamber of the double cylinder. This design permits using the arrangement according to the invention on different rail gauges, whereby the rail gauge setting range preferably lies between 1000 mm and 1458 mm. Means for blocking the fluid transmission gear are preferably provided for passing complicated curves in the track and points, whereby the fluid transmission gear can be designed as a cylinder-piston-arrangement. The blocking means can be entirely or partially arranged in the vicinity of gearing for the transversal movement of the mount. It is, however, also possible to arrange the blocking means in the vicinity of the measuring wheels of corresponding grinding modules for both rails.

In a further arrangement according to the present invention a plurality of grinding modules can be seated on the frame and corresponding front and rear measuring wheels, considered in the direction of the grinding carriage, can be pivotally joined to the frame for executing movements in vertical directions.

In a further favorable embodiment, provided that the requirements to accuracy are satisfactory for an actual case of application, the grinding modules can be combined in groups on a frame, and each grinding module group is attached to a support which is pivotally seated on the frame in a plane at least approximately parallel to one of the rails. In this case, the measuring wheels are advantageously associated to the grinding module groups. Each of the measuring wheels which are arranged between the grinding module groups is active for the two neighboring grinding module groups which, in the vicinity of the measuring wheels located between them, are pivotally joined to one another about an axis which is arranged substantially at right angles to the rail to be ground.

The invention will be explained in more detail by virtue of the schematical drawings.

DETAILED DESCRIPTION OF THE INVENTION

Figure 1:
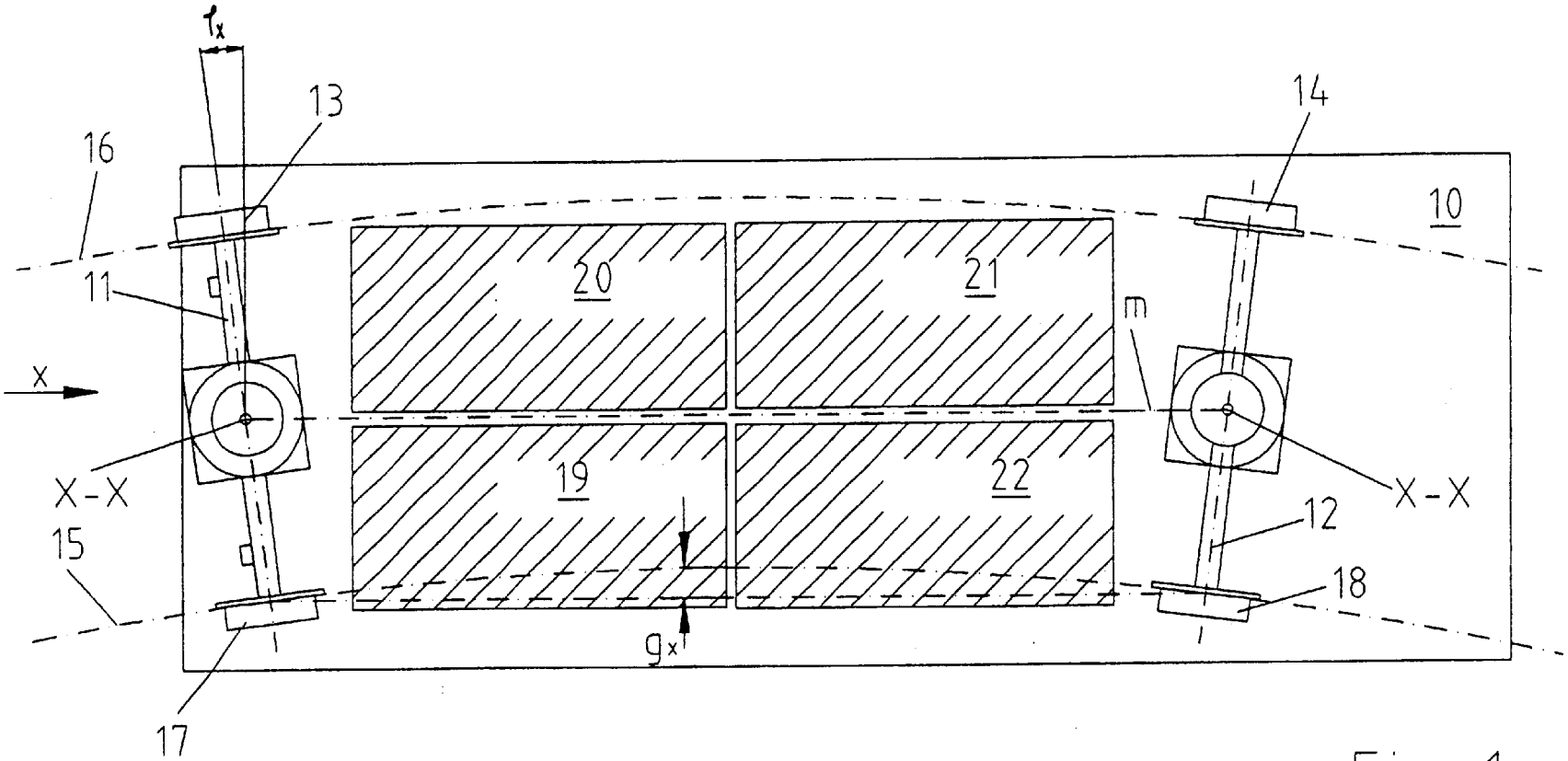
FIG. 1 a plan view of a grinding carriage substantially characterized by wheel axles between which arrangements according to the present invention (reprofiling units) are provided, FIG. 2 a lateral view of an arrangement according to the present invention with three grinding modules, FIG. 3 a plan view of the arrangements according to the present invention of FIG. 2, FIG. 4 an end view of a grinding module of the reprofiling unit, FIG. 5 a perspective view of a grinding module, FIG. 6 a lateral view of a second arrangement according to the present invention, and FIG. 7 a control logic of a fluid transmission gear with a double cylinder.

In FIG. 1 a grinding carriage 10 moving in x-direction and having a central line m is provided with two wheel axles 11, 12, whereby the wheel axles 11, 12 are seated for rotation substantially about vertical axes X—X on the carriage. Pairs of wheels 13, 14 of the grinding carriage 10 run on rails 15, 16 of a track, rail heads of which shall be worked on and reprofiled. Thereby wheel flanges 17, 18 of the wheels 13, 14 run on inner edges of the rails 15, 16, indicated by dashed curved line. Reprofiling units 19, 20, 21, 22 are attached to the grinding carriage 10 between the wheel axles 11, 12. By use of the reprofiling units 19, 20, 21, 22, the heads of the rails 15, 16 will be worked on. Due to the curvature of the rails 15, 16, the wheel axles 11, 12 are inclined relative to the central line m of the grinding carriage 10 by an angle of ±ϕx towards a not shown center of curvature. The curvature of the rails 15, 16 also effects deviations of secants gx for the reprofiling units fixedly connected to the grinding carriage 10, whereby these secant deviations also affect the grinding tools in the reprofiling units 19 to 22 and their position relative to the rails 15, 16. With too small radii of curvature of the rails 15, 16, the grinding tools will not work the entire width of the rail head, respectively they will work on the rail head in an improper manner. This disadvantage is eliminated by the arrangement according to the present invention.

Figure 2:
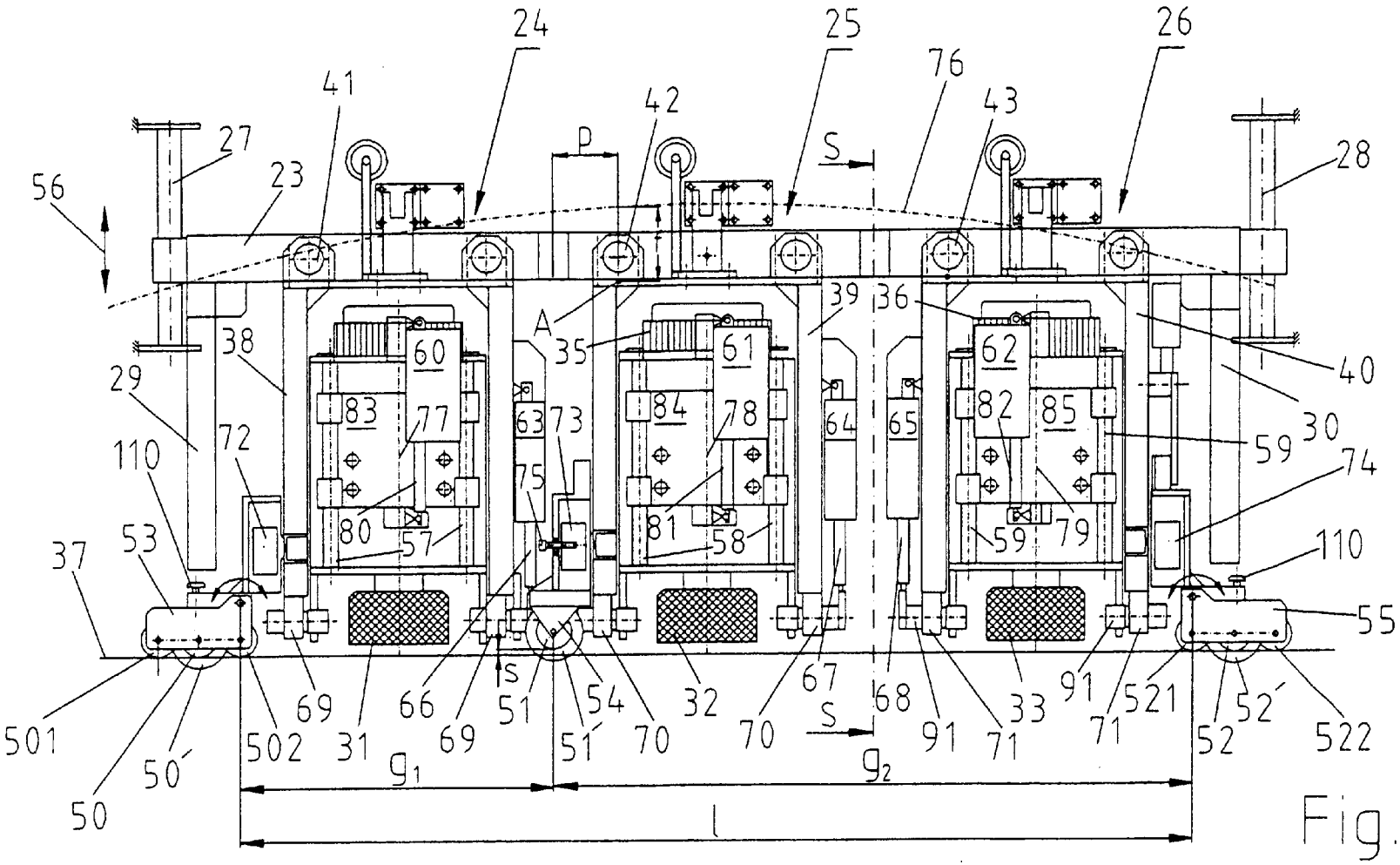
Figure 3:
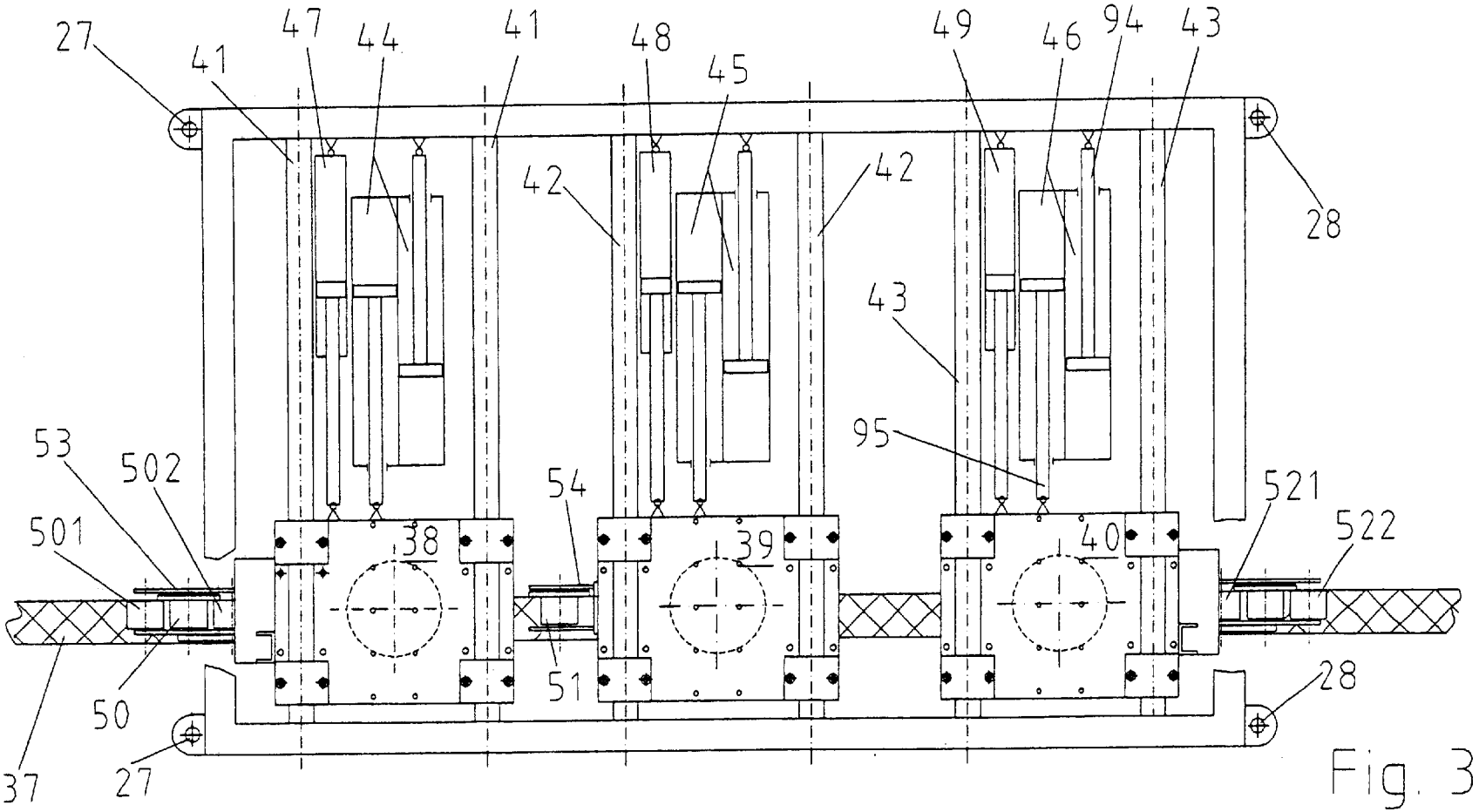

In FIGS. 2 and 3, the arrangement according to the present invention comprises a frame 23 with grinding modules 24, 25, 26, whereby the frame 23, by the aid of drive means 29, 30, is arranged vertically displaceable in the direction of a double arrow 56 at guide means 27, 28 which, in turn, are secured to the (here not shown) grinding carriage. The drive means 29, 30 can be pneumatically operating ones. Each of the grinding modules 24, 25, 26 is provided with a grinding disk 31, 32, 33 which is driven by an electric-motor arranged in a housing 34, 35, 36 to grind a rail head (surface) 37 of a rail 15 (FIG. 1) and which will be, along guides 57, 58, 59, driven by respective electric-motors 60, 61, 62 substantially at right angles to the respective rail 15, transported to the respective rail 15 and pressed onto the same. The housing 34, 35, 36 is pivotally seated at a respective mount 38, 39, 40 about an axis at least approximately in parallel to the rail 15 to be ground, for grinding the cross-profile of the rail head. To his end electric-motors 63, 64, 65 are provided at the mounts 38, 39, 40 which, via respective motion transmission means 66, 67, 68, effect the pivotal movement of the housing 34, 35, 36 and of the guides 57, 58, 59 in bearings 69, 70, 71 at the respective mount 38, 39, 40. The mount 38, 39, 40 is arranged on the frame 23 for displacements along guides 41, 42, 43 which are substantially horizontally positioned and transversal to the rail head 37. Drive means 44, 45, 46, for example, pneumatic double cylinders are employed for transverse displacing the mounts 38, 39, 40, whereby the drive means are partially attached to the associated grinding module 24, 25, 26 and partially to a suitably location on the frame 23. The action of the grinding modules can be neutralized by blocking means 47, 48 49, for example, hydraulic blocking cylinders.

To each grinding module 24, 25, 26 belongs a measuring wheel 50, 51, 52 with a wheel flange 50', 51', 52', which is seated in an associated bearing block 53, 54, 55 and which can be put on the rail head 37 by displacing the frame 23 along the guides 27, 28. Rollers 501, 502, and 521, 522, respectively advance and trail the measuring wheels 50 and 52 in order to prevent short waves and grooves in the surface of the rail from being followed. By the aid of adjusting screws 110, the bearing block 53, 55 with the corresponding measuring wheel 50, 52 and the respective rollers, advancing respectively trailing the latter, is pivotally seated at the respective grinding module 24, 25, 26, with the definable pivotal movement being about a substantially horizontal axis and transverse directed to the rail head 37. Additionally, the measuring wheels 50, 51, 52 and their bearing bodies 53, 54, 55 are displaceably arranged at the respective mount 38, 39, 40 transverse to the rail head 37 and parallel to the respective guide 41, 42, 43. To this end respective drive means 72, 73, 74. of the grinding modules 24, 25, 26 are provided, which are exemplarily and in more detail shown and explained in the FIGS. 4 and 5 with slight differences. To avoid any reactive forces, there is provided a tolerance s (about 0.3 to 0.8 mm) for the mean grinding module 25 relative to the rail head 37, when the measuring wheels 50 and 52 bear upon the rail surface 37, whereby the tolerance can be finely adjusted by a cam screw 75. Provided that the grooving wave peaks are greater than the given tolerance, the mean grinding module 25 can escape in vertical direction by an amount f, which is indicated by a dash-point curved line 76, so that the bridge length or the measuring length 1 between the outside measuring wheels 50, 52 is maintained. When g1 is the distance of the axis of rotation of the trailing roller 502 from the axis of rotation of the measuring wheel 51, and g2 the distance of the axis of rotation of the advancing roller 521 from the axis of rotation of the measuring wheel 51, and when p is the projection of the distance of the axis of rotation of the measuring wheel 51 from the nearest positioned horizontal guide 42 onto the rail surface 37, then under the condition that p<<g1, there will approximatively result in the point A $$f=(FA\cdot h/E\cdot I)\cdot gi\cdot(l-gi),$$

where I is the surface momentum, E is the elastic modulus, FA is the force in the point A. When the grinding carriage 10 is moved to a place of work or from one place of work to the next one, then the grinding tools 31, 32, 33 are up over the rail level, that is, they and their reprofiling units 19, 20, 21, 22 are withdrawn from the rails 15, 16 and from the rail surface 37, respectively. After the distances between the grinding tools of the reprofiling units associated to the rails 15 and 16 have already been adjusted by the aid of the drive means 44, 45, 46, the frames 23 of the individual reprofiling units 19 to 21 are lowered in such a way that the grinding wheels 31, 32, 33 are directly positioned above the rails 15, 16 to be ground. Simultaneously the measuring wheels 50, 51, 52 of all reprofiling units 19 to 22 are lowered down to the rails 15, 16 and the rail surface 37, respectively. The drive means 44, 45, 46 ensure that, during the grinding process, the wheel flanges 50', 51', 52' of all the measuring. Wheels of the reprofiling units 19 to 22 are in contact to the rail heads 37, in other words, that the measuring wheels are backlash-free guided by the rails 15, 16. The electric motors 34, 35, 36 rotate the grinding wheels 31, 32, 33 about the axes 77, 78, 79. The inclination of the grinding wheels 31, 32, 33, corresponds to the transversal profile of the rail heads 37 and is accordingly variable in transversal planes relative to the rails 15, 16 together with the electric motors 63, 64, 65 and the motion transmission means 66, 67, 68. Together with the variation of inclination there also are changed the positions of the guides 57, 58, 59 and of the slides 83, 84, 85, guided by the former. The advance of the grinding tools 31, 32, 33 to and pressing them into contact with the rails is achieved by the electric-motors 60, 61, 62 via motion transmission means 80, 81, 82 and slides 83, 84, 85. On the slides 83, 84, 85 there are the motor housings 34, 35, 36 provided for rotationally driving the grinding wheels 31, 32, 33 and there are seated the drive shafts 86, 87, 88 of the grinding wheels, themselves. After completion of the grinding process, the frame 23 is moved along the guides 27, 28 substantially in vertical direction by aid of the drive means 29, 30. Thus the grinding wheels 31, 32, 33 are withdrawn from the rail heads 37 and all the drive means and the motors are turned off. The entire arrangement according to the present invention is made ready for transportation.

Figure 4:
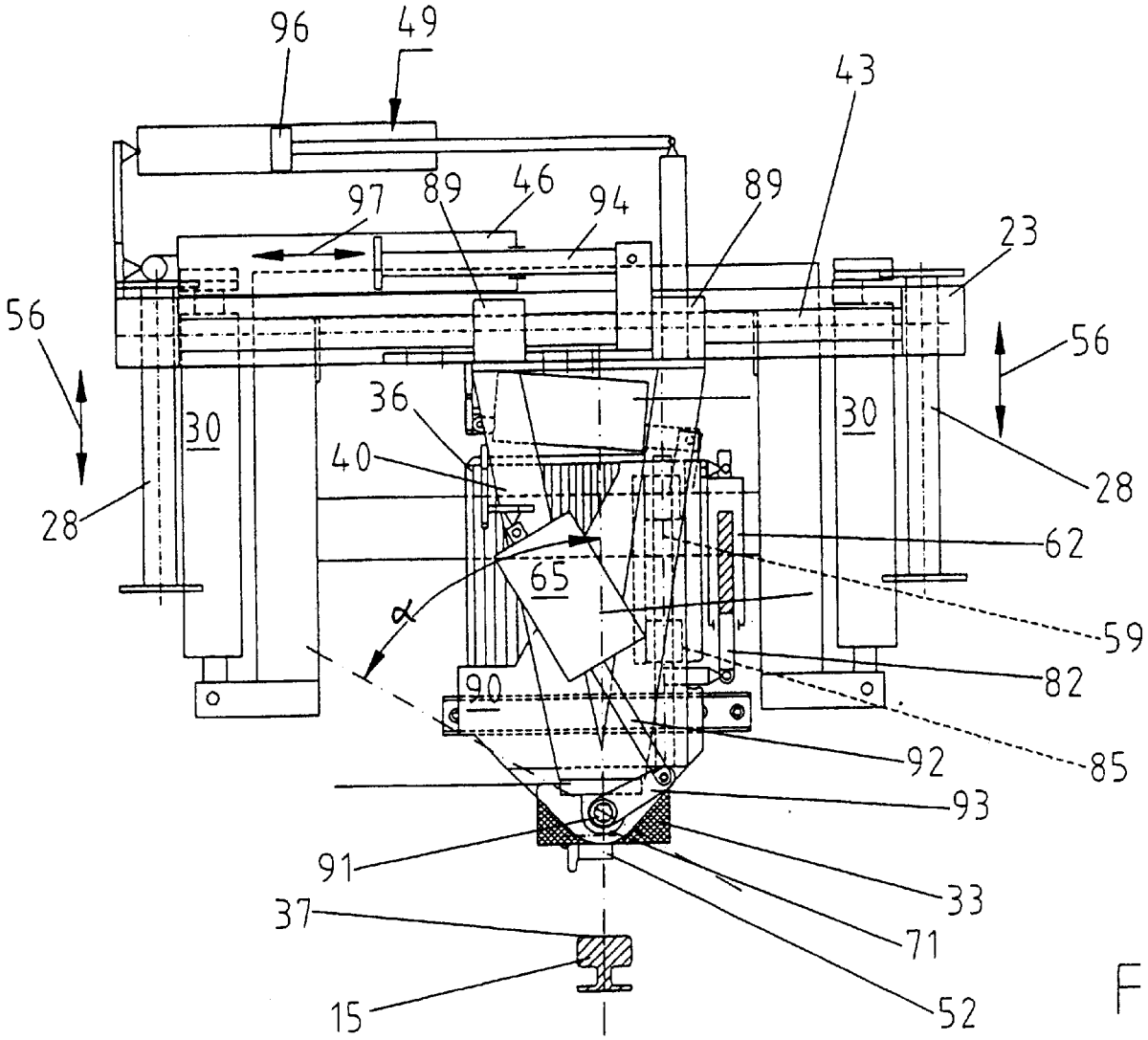

FIG. 4 substantially comprises a section along a line S—S in FIG. 2, and represents an end view of the grinding module 26: The mount 40 is pneumatically preset to the distance of the rails 15, 16. This is achieved, substantially in horizontal directions indicated by the double arrow 97, by aid of the double cylinders 46 and by the pistons 94, 95 sliding within the former. One of the pistons, in the present case piston 94 (FIG. 3) is attached to the frame 23 and the other one, 95, is attached to the mount 40. The blocking means 49, which here operates pneumatically, allows to arrest the presetting, whereby the arrest is, for example, necessary when a point is passed. The piston 96 of the blocking means is, for example, fixedly connected to the mount 40 and the cylinder 49 accordingly to the frame 23. Furthermore, the frame 23 is substantially vertically displaceable by pneumatic cylinders 30 along guides 28 in the directions indicated by the double arrow 56. In the represented state, the frame 23 is in the upper (transportation) position.

In the frame 23, the guides 43 are arranged in pairs upon which the mount 40 may slide in axial bearings 89. There are only one guide and two associated axial bearings 89 visible.

The drive 62, preferably an electric motor, which is fixedly connected to the guides 59 via a base 90, moves the slide 85 via the drive transmission means, which here is a push rod 82, the drive transmission means being pivotally connected to the slide. Thus the housing (motor) 36, which is secured to the slide 85, with the grinding tool 33 is pressed against the surface 37 of the rail 15, whereby the grinding tool 33 is mounted on a not visible motor shaft. Thereby the measuring wheel 52 contacts the rail surface 37.

In order to rectify the transversal profile of the rail head, the base 90 is pivotally seated at the mount 40 in bearings 71, which are in the vicinity of the rail 15, the base 90 including the guides 59, the slide 85, to which the housing 36 for driving the grinding tool 33 and, hence, the grinding tool 33 itself, is secured. The grinding tool 33 has axial pivots 91 which are substantially in parallel to the rail 15. A drive 65, realized by an electric-motor, provides for a pivot motion, whereby the drive is pivotally connected to a lever 93, which is secured to a pivot 91 by way of a push rod 92.

Figure 5:
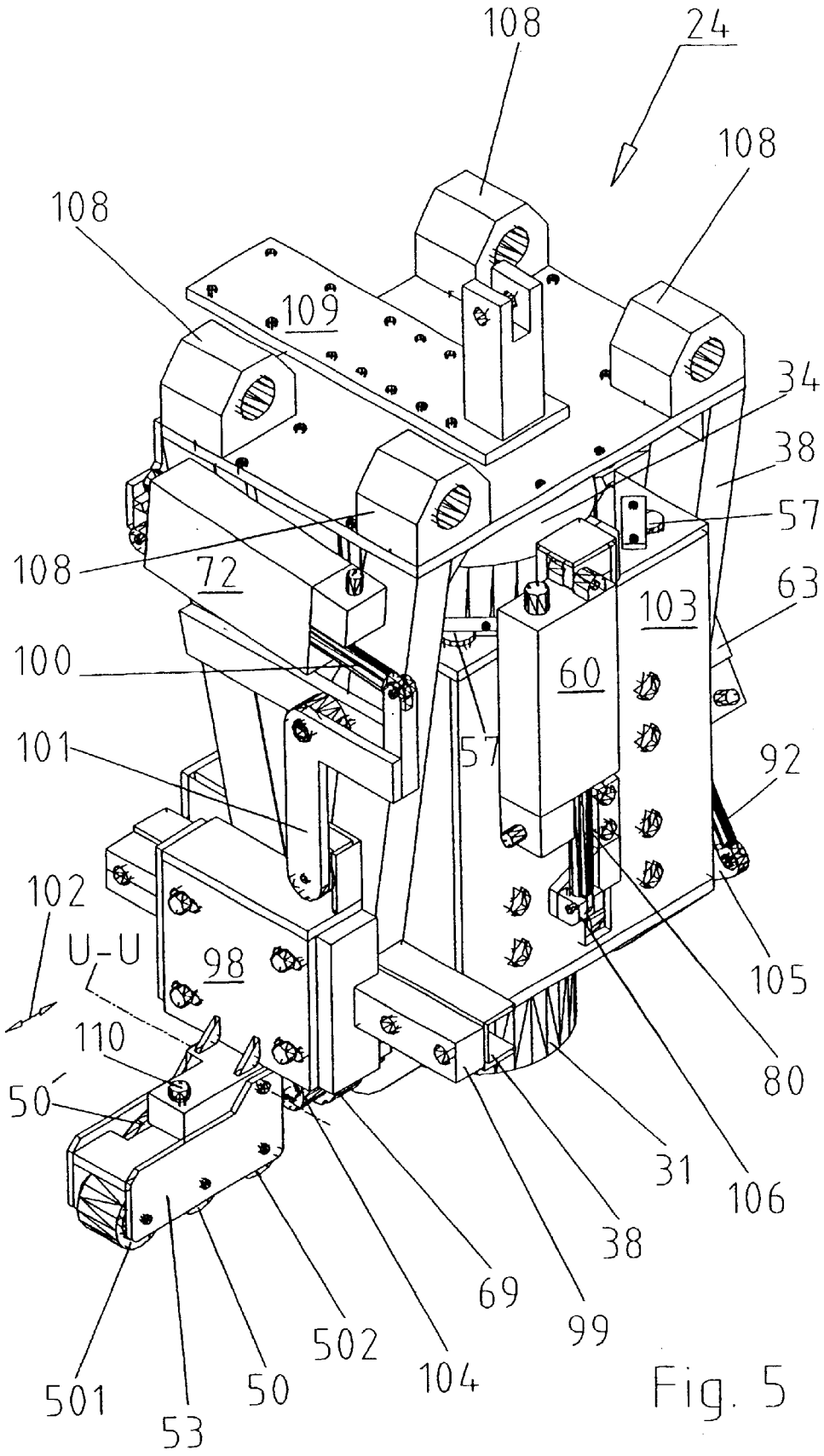

In FIG. 5, a measuring wheel 50 having a wheel flange 50', as well as a roller 501 advancing the measuring wheel 50, and a roller 502 trailing the measuring wheel 50, are rotatable about axes, which are parallel to one another, and, together with the grinding module 24, are seated in a bearing block 53 for displacements in directions indicated by the double arrow 102. The bearing block 53 is seated for rotation about an axis U—U in a holder 98. The holder 98 is slidingly engaged in a guidance 99, preferably a dovetail guideway, which is in parallel to the axes of rotation of the measuring wheel 50, the roller 501 and 502, and is rigidly connected to a mount 38. An adjustment screw 110 permits to adjust the bearing block 53 by pivotal movements about the axis U—U. A drive means in the form of an electric-motor 72 is secured to the mount 38, which moves a push rod 100 in its axial direction. To the end of the push rod 100, projecting from out of the electric-motor 72, one arm of a three-armed lever 101 is pivotally connected, the lever, which is seated at the mount 38, is connected to the holder 98 via another arm. The drive means 72 with the lever 101, the holder 98 and its guiding device 99 is, for the grinding process, adjusted in a manner that the measuring wheel 50 with its wheel flange 50, is positioned as desired relative to the mount 38 according to the set grinding angle a with respect to the transversal profile of the rail.

At the mount 38, a housing 103 is seated for rotations on pivots 104 in bearings 69, only one of which is visible in the vicinity of the bearing block 53, whereby the rotations are about an axis, which is in parallel to the double arrow 102. Similar as in FIG. 4, an electric motor 63, which is secured to the mount 38, provides for the rotations, whereby the electric motor 63 acts upon a lever 105 via an axially displaceable push rod 92. The lever 105 is rigidly connected to a not visible pivot. In the housing 103, a substantially not visible slide 106 (similar to the slide 83 in FIG. 2) is displaceable along guides 57 substantially vertically and at right angles to the direction of displacement 102. The slide 106 supports the housing 34 of the drive motor for the grinding tool 31. An electric motor 60 which is attached to the outside of the housing 103 is employed for displacing the slide 106, whereby the electric motor cooperates with a motion transmission means 80 which is engaged with the slide 106.

Sliding elements 108 for the not shown guides (41 in FIG. 2 and 3) are attached to the mount 38. Furthermore, a bearing block 109 is provided at the mount 38 for pivotally seating the pistons which, according to FIG. 3 slide within the cylinder 47 and in a part of the double cylinder 44.

Figure 6:
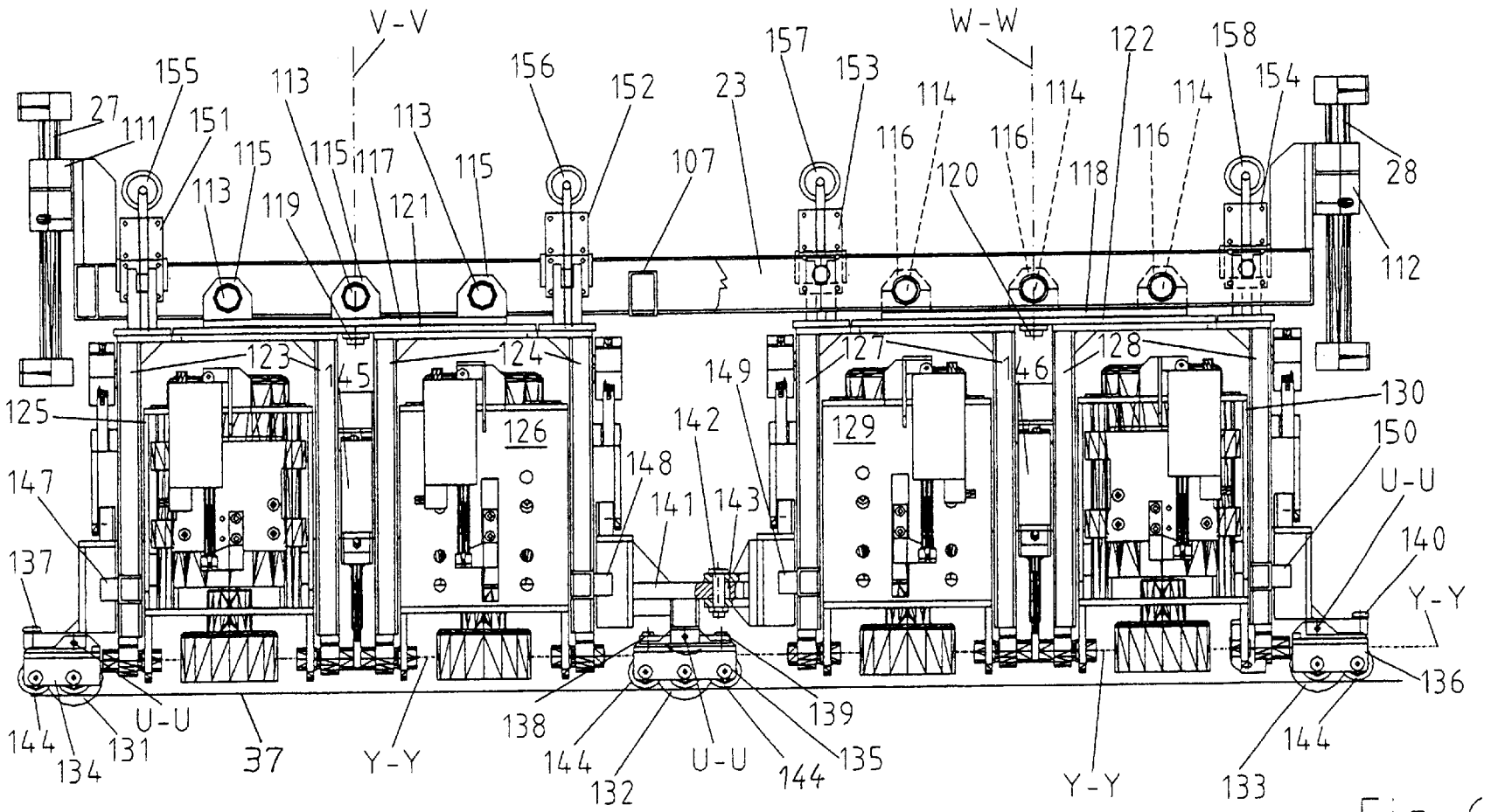

In FIG. 6, a frame 23 with slide bearing pairs 111, 112 are displaceable along vertical guide pairs 27, 28, whereby the left half shows the frame in a sectional view, and the right half in a side view. The frame 23 is substantially aligned parallel to the rail head 37 to be worked on, and it is provided with at least one stabilizing cross-tie 107, approximately in the center of its long side. To the right and to the left of the cross-tie 107, there are arranged, on each side, three cylindrical guides 113 and 114, respectively. The three cylindrical guides 113 and 114 are arranged in a horizontal plane in parallel to the rail head 37 and at right angles to the drawing plane, whereby respective guide elements 115 and 116, respectively, of a slide 117 and 118, respectively, are dispiaceably seated on the respective three cylindrical guides. One support plate 121 and 122, respectively, is pivotally (by about 15°) seated approximately centrally on each slide 117, 118 by way of a bearing bolt 119 and 120, respectively, each, for rotating about a vertical axis V—V and W—W, respectively. On each side of the bearing bolt 119, a mount 123, 124 each including one grinding module 125, 126, is attached to the support plate 121. In the same way on each side of the bearing bolt 120, a mount 127, 128 each including one grinding module 129, 130, is rigidly connected to the support plate 122. The mounts 123, 124, 127, 128 and the grinding modules 125, 126, 129, 130 are designed and arranged in analogy to FIGS 2, 4, 5. Hence, the grinding modules 125, 126, 129, 130 can be rotated about axes Y—Y in their respectively associated mounts 123, 124, 127, 128, whereby the axes Y—Y are in parallel to the rail heads 37; thereby the amounts of rotation of the grinding modules on the support plate 121 can differ (by 1–3) from the amounts of rotation of the grinding modules on the support plate 122, when grinding different facings, since the modules attached to one support plate only are provided with one device 145, 146, each, for rotations about the axis Y—Y. In FIG. 6, the grinding modules 125 and 130 are shown in sectional view, whereas the grinding modules 126 and 129 are shown in elevation. In the representation, all grinding modules are shown in a vertical plane parallel to the rail head 37.

Two measuring wheels 131, 132 and 133, 132, respectively, are associated to the respective support plates 121 and 122, and the grinding modules 125, 126 and 129, 130, respectively, which are correspondingly associated to the support plates. Thereby the mean measuring wheel 132 acts for both support plates 121, 122. The measuring wheels 131, 132, 133 are seated in respectively associated bearing blocks 134, 135, 136 and are seated at the respective mount via axes U—U transverse to the rail head 37. Adjustment screws 137, 138, 139, 140 are adapted to improve the position of the measuring wheels 131, 132, 133 relative to the corresponding mount 125, 126, 129, 130. Suitable drive means 147, 148, 149, 150 are provided for each mount for adjustment of the measuring wheels 131, 132, 133 relative to the respective mount 123, 124, 127, 128.

The common measuring wheel 132 is rigidly connected to the support plate 121 via an arm 141 and the mount 124. The two units secured to the support plates 121 and 122 are articulated to one another by a hinge 142 in the vicinity of the common measuring wheel 132. Due to an elongated slot 143, the hinge 142 allows for a slight clearance, which is adapted to permit the passage through the smallest curves to be passed by the respective grinding carriage, and which is parallel to the driving direction and, hence, parallel to the rall head 37. In analogy to FIG. 2 and 5, rollers 144 are associated to the measuring wheels 131, 132 133.

Two drive means 151, 152 and 153, 154, respectively, are associated to eah support plate unit 121, 122, the drive means being in the form of pneumatically operating double cylinders are provided for executing the transversal motion of the support plates 121, 122. Thereby, the individual cylinders of each double cylinder are arranged on top of each other. Each drive means 151 to 154 is additionally provided with a blocking means 155, 156, 157, 158 for blocking the drive action, the blocking means 155, 156, 157, 158 being designed as a hydraulically operating cylinder-piston combination. The pneumatically and hydraulically operating cylinders and pistons are in a suitable manner connected partially to the framne 23 and partially to the mounts 123, 124, 127, 128.

Due to the articulated connection of the support plate units 121 and 122 it is ensured that the grinding procedure can be efficiently and precisely carried out even with the smallest radii (15–20 m), hence, that the measuring wheels neither jump off the rail heads to be ground nor reactive forces result. As to the remaining, the disclosure with respect to FIGS. 1 to 5 is valid in its general sense.

Figure 7:
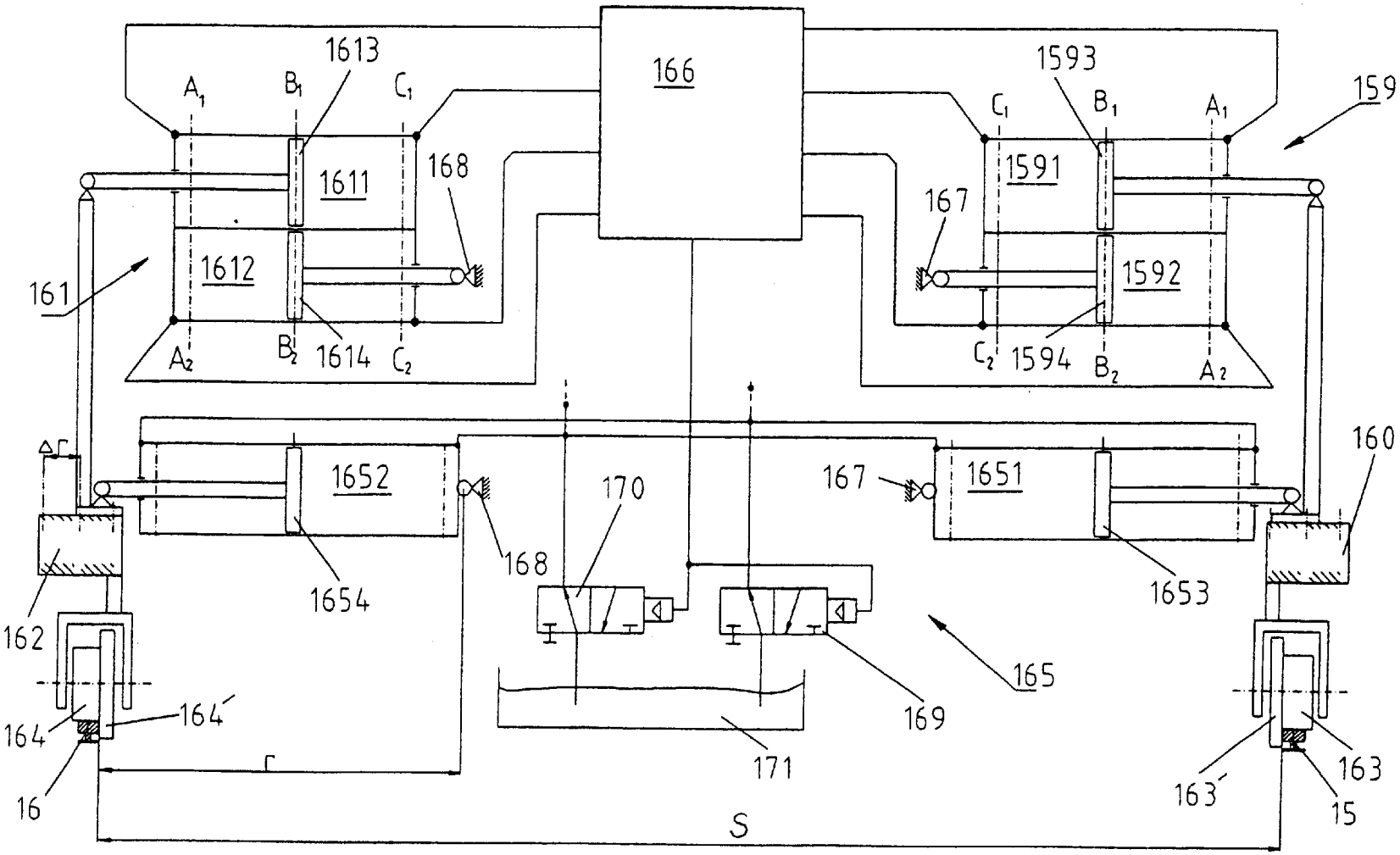

In FIG. 7 there are substantially shown a fluid gear 159 for a grinding module 160 for a right rail 15 and a fluid gear 161 for a grinding module 162 for a left rail 16. Each of the fluid gears 159, 161 is gas driven and comprises a double cylinder, in the cylinder chambers of which, 1591 and 1611, respectively, and 1592 and 1612, respectively, pistons 1593 and 1613, respectively, and 1594 and 1614, respectively, are arranged for being displaced in opposition to one another. The pistons 1593 and 1613 are each articulated to the respective module 160, 162 and pistons 1594 and 1614, respectively, are articulated to the associated frame 167, 168. A measuring wheel 163 and 164, respectively, having each a respective wheel flange 163', 164' is associated to each grinding module 160, 162.

Furthermore, a fluid blocking device 165 is represented, which blocks the action of the right and the left fluid transmission gear 159, 161 when, for example, the grinding carriage (10 in FIG. 1) passes a point. The blocking device 165 prevents the fluid transmission gear 159, 161 from pressing the wheel flanges 163', 164' of the measuring wheels 163, 164 against the rails within the point. This is of importance as to the operation of the arrangement according to the present invention since only the wheel flanges 163', 164' are provided with sensorial functions in the grinding procedure. The blocking device 165 is hydraulically operated (for example, by glycol) and has two cylinders 1651, 1652 which are articulated to the corresponding frame 167 and 168, respectively. In the cylinders, pistons 1653 and 1654, respectively, are slidingly arranged which are articulated to the respectively associated grinding modules 160, 162. The cylinders 1651, 1652 are connected to a fluid reservoir 171 via two-way valves 169, 170. Furthermore, control means 166 are provided which control the state of pressure in the fluid transmission gear 159, 161 in dependence on the operation position, the positioning position and the position of rest of the grinding modules 160, 162.

In the following, the cylinders 1591 and 1611 are referred to as positioning cylinders P1, and the cylinders 1592 and 1612 are referred to as working cylinders P2. Each cylinder P1 can take the positions A1, B1, C1, and each cylinder P2 can take the positions A2, B2, C2. Before the grinding procedure can start, the grinding modules 160, 162 have to be set to the rail gauge S, whereby there remains at first, for safety reasons, an air gap between the wheel flanges 163', 164' and the rails 15 and 16, respectively, on a straight line, before a lowering between the rails 15, 16 can take place. A rail gauge r is available for the grinding module 160 (or for both grinding modules 160, 162) and, correspondingly, for the measuring wheel 163 (or for both measuring wheels 163, 164) for setting the rail gauge. The rail gauge r can be varied by Ar by varying the pivotal connection of the grinding modules 160, 162 to the pistons P1 (1591, 1611) and to the pistons 1651, 1652. Only after the measuring wheels 163, 164 have been lowered onto the respective rails 15, 16 the fluid transmission gears 159, 161 and the fluid blocking devices 165 are activated by the control means 166.

In the positioning operation, starting from a position of rest, which can be, in principal, as desired, the pistons 1593 and 1613 take within the positioning cylinders P1 the positions C1, and the pistons 1594 and 1614 take within the working cylinders P2 the position C2. In the working position the control means 166 affects the cylinders P1 and P2 in such a way that the pistons 1593 and 1613 in the positioning cylinders P1 are retained in the positions C1, and in the working cylinders P2 the positions A2 are on the way to be taken. With straight rails 15, 16, however, the position C2 in the working cylinders P2 is kept to, and the control means 116 biases the working cylinders P2 to the preset nominal pressure. When the grinding machine according to FIG. 1 is now driving into an arc of circle, and when taking into consideration the module 160 across the rail 15, then the grinding module is displaced by a distance gx relative to the center m (FIG. 1) of the carriage. The piston 1594 moves from C2 towards A2 by the distance gx, since the piston 1593 already takes its end position C1. Conversely, with respect to the outer curve rail 16, there is valid that the piston 1613 from C1 and, hence, the grinding module 162 by the distance gx will be forced to the outside in direction of A1, since the piston 1612 is already in its end position C2. When passing through alternating curves, the pistons of P1 and P2 move in direction of B1 and B2, due to the equal gas pressure in P1 and P2 initiated by the control means. Thus, a dynamic balance of displacement is possible in horizontal direction, when there are curves passed through. In the transportation state of the grinding carriage, that is, when there are no reprofiling operations carried out, the grinding modules are entirely displaced to the interior, relative to the center m of the carriage.

The blocking device 165 of FIG. 7 allows the same adjustment path for each piston 1653 and 1654, respectively, in the associated cylinder 1651 and 1652, respectively, as the fluid transmission gear 159, 161 does for the pistons 1593, 1594 and 1613, 1614, respectively, in the double cylinders 1591, 1592 and 1611, 1612, respectively. The two-way valves 169, 170 are pneumatically controlled by the control means 166.

FIG. 7 shows the hydraulic circuit at a zero pressure state, the two-way valves 169, 170 do not block the hydraulic circuit to the fluid reservoir 171. In this state the grinding modules 160, 162 can be freely positioned, pressed into contact and lowered. When the two-way valves 169, 170 are blocked towards the reservoir 171, the fluid can only move between and in the cylinders 1651, 1652, the action of the fluid transmission gear 159,161 is blocked, the grinding modules 160, 162 and their measuring wheels 163, 164 are maintained in the blocked state. Thus, one measuring wheel will always be the guiding one at superelevations in the rails and in points. This will be the measuring wheel in the inner curve at superelevations and the track-bound measuring wheel in the points.

The hydraulic duct can be extended mirror-invertedly for further modules, so that further modules can be added and can be combined to form groups. However, one group should not comprise more than three or four module pairs. It is also possible to attach the blocking means to the bearing blocks and/or to have the blocking means manufactured with one cylinder only.

All features disclosed in the specification, in the subsequent claims, and in the drawing can be substantial for the invention both, individually and in any combination with one another.

What is claimed is:

1. A rail grinding machine for grinding at least one rail, comprising:

a frame movably mounted in the rail grinding machine and having frame actuators to move said frame at least vertically relative to a rail to be ground;

grinding modules, each including a grinding machine and grinding machine actuators for moving said grinding machine relative to said frame to move vertically relative to the rail, horizontally transverse relative said rail, pivotally relative the rail about an axis substantially parallel to the rail; and measurement wheels, one of said measurement wheels being assigned to each of said grinding modules, measurement wheel actuators for effecting relative movement of said measurement wheels and said grinding modules in a direction horizontally transverse to the rail.

2. The rail grinding machine of claim 1, wherein each grinding module includes:

a rack movably mounted on said frame to move horizontally traverse relative to the rail;

a sliding carriage supporting said grinding machine and movably mounted on vertical guides; and said vertical guides being pivotally mounted on said rack to effect said movement of said grinding machine pivotally relative the rail about the axis substantially parallel to the rail to be ground.

3. The rail grinding machine of claim 2, wherein each of the racks includes at least two rack members movably supported on said frame to move horizontally traverse relative to the rail.

4. The rail grinding machine of claim 3, wherein said grinding machine actuators include fluid drives provided on the frame for the horizontal adjustment of the at least two racks.

5. The rail grinding machine of claim 4, wherein blocking devices are provided for blocking action of the fluid drives.

6. The rail grinding machine of claim 4, wherein the fluid drives have two double cylinders with two pistons moving in opposite directions in these double cylinders.

7. The rail grinding machine of claim 1, wherein, in each of said grinding modules, said measurement wheel actuator is an electric motor which adjusts the grinding modules relative to said assigned one of said measurement wheels.

8. The rail grinding machine of claim 1, wherein said measurement wheels include front and rear measurement wheels pivotally mounted on the frame to provide for vertical adjustment.

9. The rail grinding machine of claim 1, wherein the grinding modules are arranged in groups mounted on a support structure which is support by the frame and is in a plane at least approximately parallel to the rails, and adjacent groups of said groups share a measurement wheel.

10. The rail grinding machine of claim 9, wherein the adjacent groups are hinged to one another at the measurement wheel shared between them.

* * * * *